US009765659B2

(12) United States Patent
Walther et al.

(10) Patent No.: US 9,765,659 B2
(45) Date of Patent: Sep. 19, 2017

(54) DIAGNOSTIC METHOD FOR A VALVE DRIVE ACTUATOR

(71) Applicant: Schaeffler Technologies AG & Co. KG, Herzogenaurach (DE)

(72) Inventors: Christoph Walther, Adelsdorf (DE); Arne Manteufel, Bamberg (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 140 days.

(21) Appl. No.: 14/765,076

(22) PCT Filed: Dec. 11, 2013

(86) PCT No.: PCT/DE2013/200349

§ 371 (c)(1),
(2) Date: Jul. 31, 2015

(87) PCT Pub. No.: WO2014/121771

PCT Pub. Date: Aug. 14, 2014

(65) Prior Publication Data

US 2015/0377095 A1 Dec. 31, 2015

(30) Foreign Application Priority Data

Feb. 5, 2013 (DE) ..... 10 2013 201 827

(51) Int. Cl.
*F01L 13/00* (2006.01)

(52) U.S. Cl.
CPC ..... *F01L 13/0036* (2013.01)

(58) Field of Classification Search
CPC ..... F01L 13/0036; F01L 2013/0052; F01L 2800/11; F01L 2800/12; F01L 2009/0409; F02D 41/221
See application file for complete search history.

(56) References Cited

U.S. PATENT DOCUMENTS 6,967,550 B2 * 11/2005 Elendt ..... F01L 13/0036 123/90.11
8,047,065 B2 * 11/2011 Cinpinski ..... F01L 1/34 73/114.79

(Continued)

FOREIGN PATENT DOCUMENTS

DE 10 2007 010 149 A1 9/2008
DE 102008020893 10/2009

(Continued)

*Primary Examiner* — Freddie Kirkland, III

(74) *Attorney, Agent, or Firm* — Davidson, Davidson & Kappel, LLC

(57) ABSTRACT

A method for diagnosing an electromagnetic actuator of a sliding cam valve drive of an internal combustion engine. An actuator pin is released by electrical energizing of the actuator and is introduced into a groove-like sliding slot which passes through a cylindrical slot section of the associated sliding cam-and ends in a slope onto the cylindrical circumference of the slot section. The method includes: energizing the actuator using current parameters of a variable actuator characteristic map so that the actuator pin is released when the cylindrical circumference overlaps the actuator pin circumferentially; determining whether the released actuator pin generates a rejection signal due to the slope from the sliding slot onto the cylindrical circumference; if no rejection signal is detected, repeating step a) whereas at least one current parameter is changed and step b); updating the actuator characteristic map with the changed current parameter.

8 Claims, 6 Drawing Sheets

(56) References Cited

U.S. PATENT DOCUMENTS

| | | | | |
|---|---|---|---|---|
| 8,181,508 | B2 * | 5/2012 | Cinpinski | F01L 1/3442 73/114.79 |
| 8,186,320 | B2 * | 5/2012 | Schiepp | F01L 1/053 123/90.18 |
| 8,191,524 | B2 * | 6/2012 | Elendt | F01L 13/0036 123/90.16 |
| 8,365,692 | B2 * | 2/2013 | Schoeneberg | F01L 1/047 123/90.15 |
| 8,474,421 | B2 * | 7/2013 | Gregor | F01L 13/0036 123/90.11 |
| 8,584,639 | B2 * | 11/2013 | Elendt | F01L 13/0036 123/90.18 |
| 8,707,917 | B2 * | 4/2014 | Schiepp | F01L 1/047 123/90.16 |
| 2004/0201441 | A1 | 10/2004 | Elendt et al. | |
| 2010/0126445 | A1 * | 5/2010 | Schiepp | F01L 1/053 123/90.16 |
| 2010/0224154 | A1 | 9/2010 | Elendt et al. | |
| 2010/0269769 | A1 * | 10/2010 | Schoeneberg | F01L 1/047 123/90.6 |
| 2011/0016958 | A1 * | 1/2011 | Cinpinski | F01L 1/34 73/114.43 |
| 2011/0056448 | A1 * | 3/2011 | Cinpinski | F01L 1/3442 123/90.16 |
| 2011/0247577 | A1 | 10/2011 | Elendt et al. | |
| 2012/0152193 | A1 * | 6/2012 | Schiepp | F01L 1/047 123/90.15 |
| 2013/0228039 | A1 * | 9/2013 | Nendel | F01L 13/0036 74/568 R |

FOREIGN PATENT DOCUMENTS

| | | |
|---|---|---|
| DE | 102008060166 | 6/2010 |
| DE | 10 2009 009 080 A1 | 8/2010 |
| DE | 10 2009 053 116 A1 | 9/2010 |
| EP | 1 421 591 B1 | 5/2004 |
| EP | 1811161 | 7/2007 |
| WO | WO2012/072305 | 6/2012 |

* cited by examiner

DIAGNOSTIC METHOD FOR A VALVE DRIVE ACTUATOR

The present invention relates to a method for diagnosing an electromagnetic actuator of a sliding cam valve train of an internal combustion engine. The actuator has at least one actuator pin which, as a result of electrical energizing of the actuator, is released and dips into a groove-like displacement slot which passes through a cylindrical slot section of the associated sliding cam and ends, in the rotation direction of the cam, with an upward slope onto the cylindrical circumference of the slot section.

BACKGROUND

The sliding cam valve trains, which are known in various configurations, serve for actuating, with variable lift, the gas exchange valves of internal combustion engines. The variability in lift is generated by the camshaft, which includes a carrier shaft and a sliding cam situated thereon rotatably fixed and movable between axial positions. The sliding cam has at least one set of cams, including cams having different bumps, and a groove-like displacement slot into which an actuator pin, which extends out of an actuator, dips in order to move the sliding cam on the carrier shaft between the axial positions and thus to shift the present lift pick-up from one cam to the other cam.

Valve trains including electromagnetic actuators and displacement slots of the type mentioned at the outset are known from DE 10 2007 010 149 A1 with two Y-shaped and circumferentially parallel grooves, from DE 10 2009 053 116 A1 with two X-shaped and circumferentially parallel grooves, and from DE 10 2009 009 080 A1 with two S-shaped grooves arranged circumferentially in series.

The sliding cam switchover process is intended to be able to take place in a precise and reproducible manner even at a preferably high rotational speed of the camshaft and therefore within an extremely short period of time and is intended to be completed for all cylinders of the internal combustion engine within one working cycle and without any shifting errors. Ideally, therefore, all actuators of the valve train are not only sufficiently fast but also are without appreciable time variations with regard to the release and movement behavior of the actuator pins extending out of the actuator. Actuators which are particularly suitable for this have actuator pins which are held in the retracted state by the holding force of a permanent magnet counter to the force of a spring. The actuator pins are released by briefly energizing an electromagnet, which temporarily neutralizes the effect of the permanent magnet, whereupon the actuator pin extends out of the actuator due to the spring force. The return retracting movement into the actuator is brought about by the groove which slopes upward at the end of the displacement slot onto the cylindrical circumference of the slot section. The operating principle of such an actuator is known from EP 1 421 591 B1.

SUMMARY OF THE INVENTION

Of course, the minimum duration of the energization time necessary to release the respective actuator pin, in which the holding force of the permanent magnet is not yet overcome and the actuator pin remains in the retracted position, nevertheless varies in real operation. Causes for the variation in this time interval, which will also be referred to below as dead time, are in particular the mechanical and electrical manufacturing tolerances of the actuator components and their operation-related differing progression of wear. In order to ascertain the extent of this variation, often complicated parameter studies are required which may be carried out with reasonable effort but only on a limited number of samples. The maximum value for the dead time variation ascertained during these studies must then be adhered to during operational actuation of all actuators, so that the operating range, in particular the speed and temperature range, in which the sliding cam valve train could be switched over with sufficient precision is undesirably limited.

It is an object of the present invention to provide a method for diagnosing an actuator of the type mentioned at the outset, which enables an individual and up-to-date dead time ascertainment for the actuator pins with preferably little effort.

The present invention provides that the following diagnostic steps are to be carried out during operation of the internal combustion engine:

a) energizing the actuator with current parameters of a variable actuator characteristic map in such a way that the actuator pin is released when the cylindrical circumference overlaps the actuator pin circumferentially and a directly subsequent dip of the actuator pin into the displacement slot does not result in any displacement of the sliding cam;

b) detecting whether the released actuator pin generates in the actuator a rejection signal due to the upward slope from the displacement slot onto the cylindrical circumference;

c) if no rejection signal is detected, repeating step a) using at least one changed current parameter and step b);

d) updating the actuator characteristic map with the changed current parameter.

The diagnostic method according to the present invention is based on the concept of ascertaining, with predefined accuracy requirements, the dead time of preferably all actuator pins, without this leading to any displacement of the sliding cam. The instantaneously diagnosed actuator pin may be extended in order to check its present actual dead time, but may carry out no displacement in the process since it may dip only into the groove section, which is then without axial lift, at the end of the displacement slot immediately adjacent to the cylindrical circumference. Depending on the actuator energization parameters initially used in this diagnostic shifting, a rejection signal is either detected or not detected. The rejection signal is generated (for example in the form of an induced voltage that is relatively easy to detect and to process) by the actuator pin when the latter is guided back into the actuator by the displacement slot which slopes upward at the end back onto the cylindrical circumference of the slot section. A prerequisite for this is the previous release and dip of the actuator pin into the displacement slot and a corresponding energization of the actuator, from which sufficiently accurate conclusions may be drawn about the present duration of the dead time of the individual actuator pin. Based hereupon, the actuator characteristic map serving for operational control of the actuator may be updated as often as desired and with the desired accuracy in terms of the dead time to be adhered to individually for each actuator pin, and the operating range of the valve train that is permitted for switchovers may be maximized.

BRIEF DESCRIPTION OF THE DRAWINGS

Further features of the present invention result from the following description and from the drawings, which serve to explain the method according to the present invention by way of example. Unless mentioned otherwise, identical or functionally equivalent features or components are provided with the same reference numerals.

DETAILED DESCRIPTION

Figure 1:
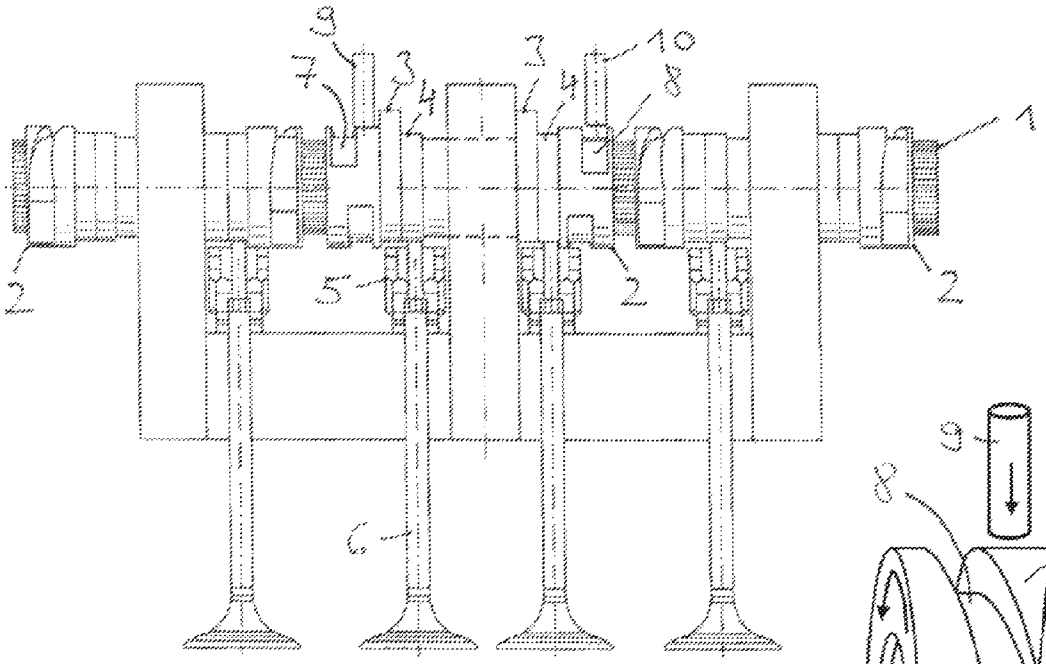
FIG. 1 shows a section of a known sliding cam valve train in side view.

FIG. 1 shows a variable-lift sliding cam valve train of an internal combustion engine, the basic operating principle of which may be summed up in that a conventionally rigid camshaft is replaced by an externally toothed carrier shaft 1 and a sliding cam 2 rotatably fixed and longitudinally movably situated thereon with the aid of an internal toothing. Each sliding cam has two sets of axially adjacent cams 3 and 4, the different lift courses of which are transmitted to gas exchange valves 6 with the aid of cam followers 5. The displacement of the sliding cam on the carrier shaft, which is necessary in order to activate the respective cam as a function of the operating point, takes place via helical displacement slots which are designed as left-hand and right-hand grooves 7 and 8 corresponding to the direction of displacement and into which a respective cylindrical actuator pin 9 and 10 of an electromagnetic actuator dips depending on the instantaneous position of the sliding cam.

FIG. 2 shows a displacement slot which is particularly suitable for carrying out the method according to the present invention, and an actuator with two actuator pins 9, 10 running thereabove. The displacement slot, which is shown in different rotation angle positions and the rotation direction of which is shown in each case at the end side, is made up of the left-hand groove 7 and the right-hand groove 8, which pass through the cylindrical slot section, the latter being shown here in isolation from the sliding cam. The two grooves, which are situated in parallel to one another in the rotation direction of the cam, are at first separated from one another by a web 11 and then unite in a Y-shape to form a single [sic; united] groove 12 which is free of axial lift and which ends with an upward slope 13 back onto the web, the circumference of which has the cylinder diameter D of the slot section.

Figure 2A:
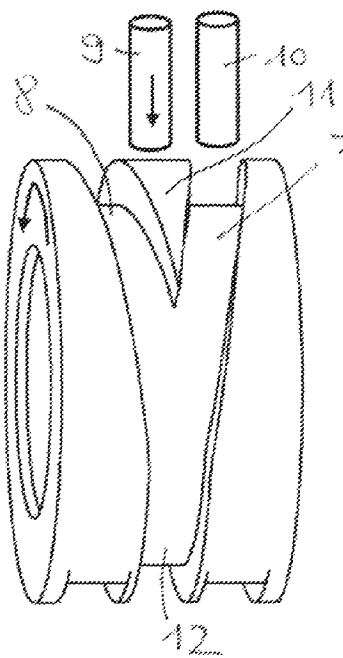
FIG. 2 shows, in an isolated diagram, a displacement slot which is known per se and which is particularly suitable for carrying out the method according to the present invention (Y-shaped groove)

FIG. 2*a*: in the diagnostic method described in detail below, the actuator pin 9 which brought about the last displacement of the sliding cam and which is presently located at the axial height of the web 11 is selectively released to dip into the united groove 12. This actuator pin may at present not carry out any displacement since it is located precisely in the middle between the left-hand groove 7 and the right-hand groove 8. The release takes place in the angle region of the displacement slot in which the web and the actuator pin still overlap circumferentially. Considered in static terms, therefore, the actuator pin would be placed onto the web in this angle region.

Figure 2B:
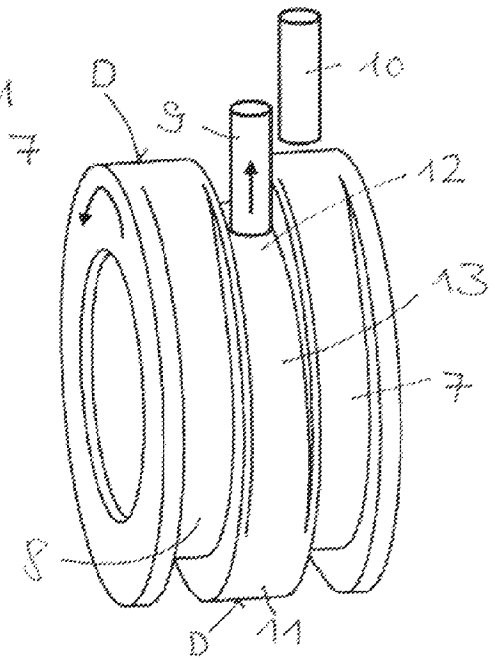

FIG. 2*b*: if the actuator pin 9 has successfully been released and then has dipped into the united groove 12, a detectable and processable rejection signal is generated when the actuator pin is retracted into the actuator by virtue of the upward slope 13 of the groove that is guided back at the end onto the cylindrical circumference D of the web 11, and induces a voltage in the process.

Figure 3:
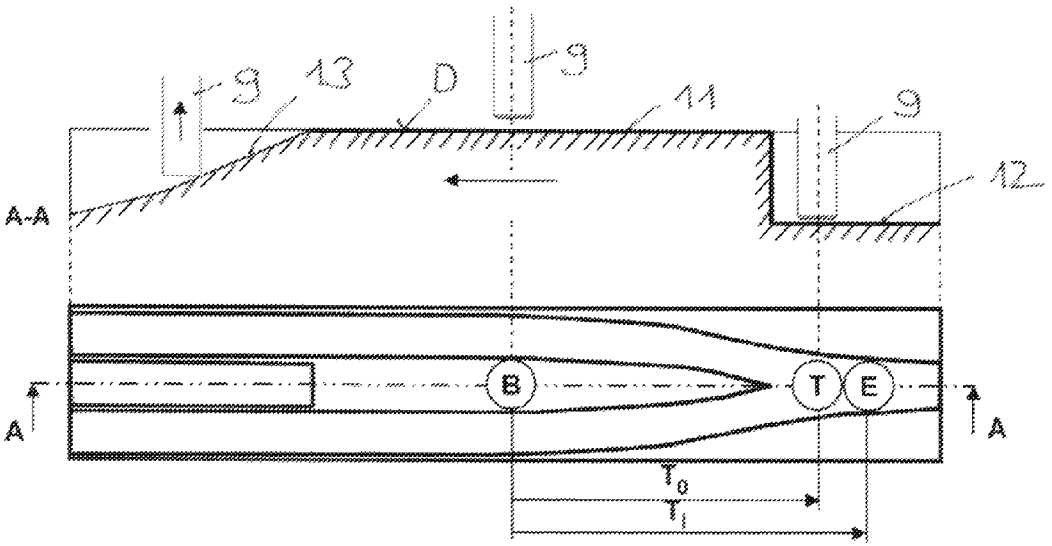
FIG. 3 schematically shows the displacement slot of FIG. 2 when a rejection signal is generated.
Figure 4:
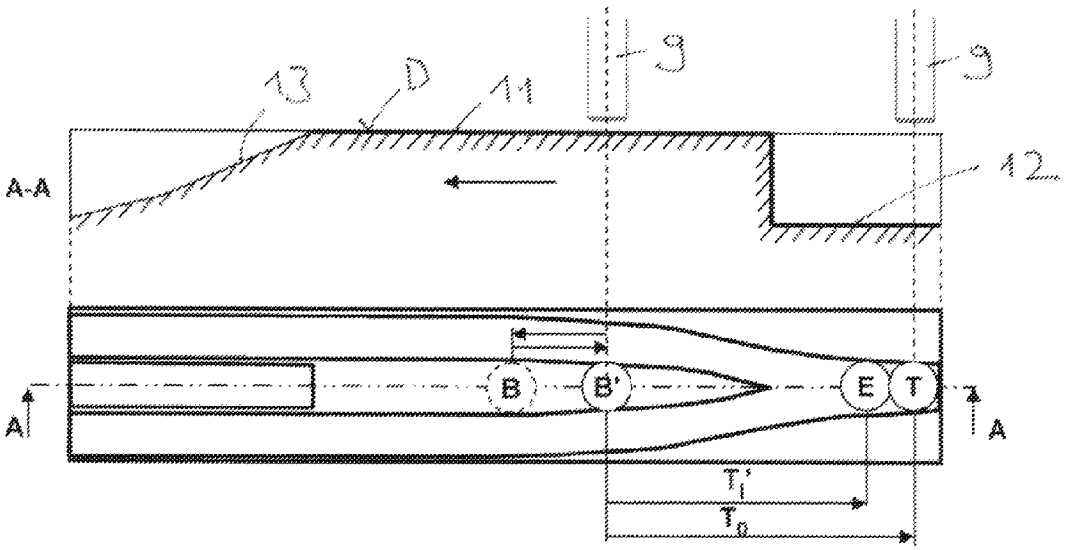
FIG. 4 schematically shows the displacement slot of FIG. 2 when no rejection signal is generated.

FIGS. 3 and 4 illustrate the prerequisites for the release and dip of the actuator pin 9 during the diagnostic shifting. Each of these figures shows an unwound displacement slot according to FIG. 2, at the top in cross section according to the section line A-A, by a top view at the bottom of the figure. The arrow shown in the cross section indicates the rotation direction of the displacement slot. The actuator is energized starting at the point in time B, and the energization is switched off at the point in time E. $T_0$ is the dead time interval in which the actuator pin, despite the actuator being energized, has not yet overcome the holding force of the permanent magnet and has therefore not yet been released. $T_0$ starts at the point in time B and ends at the point in time T. In the illustrated exemplary embodiment, the point in time E for diagnostic purposes remains unchanged, so that the change in the current parameters is limited to the energization duration $T_I$ with a changed start of energization B. Alternatively, it is also conceivable to change the end point in time E of the energization.

If, as shown in FIG. 3, the energization duration $T_I$ is longer than the dead time interval $T_0$, then the point in time T lies before the end of energization E and the released actuator pin 9 dips into the groove 12. The rejection signal is generated and detected in the region of the upward slope 13.

The situation is different in FIG. 4: here, the energization duration $T_I'$ is shorter than the dead time interval $T_0$, so that the point in time T lies after the point in time E and the actuator pin 9 is not released but rather remains in the refracted state once the energization has been switched off. In this case, therefore, no rejection signal is generated.

Figure 5:
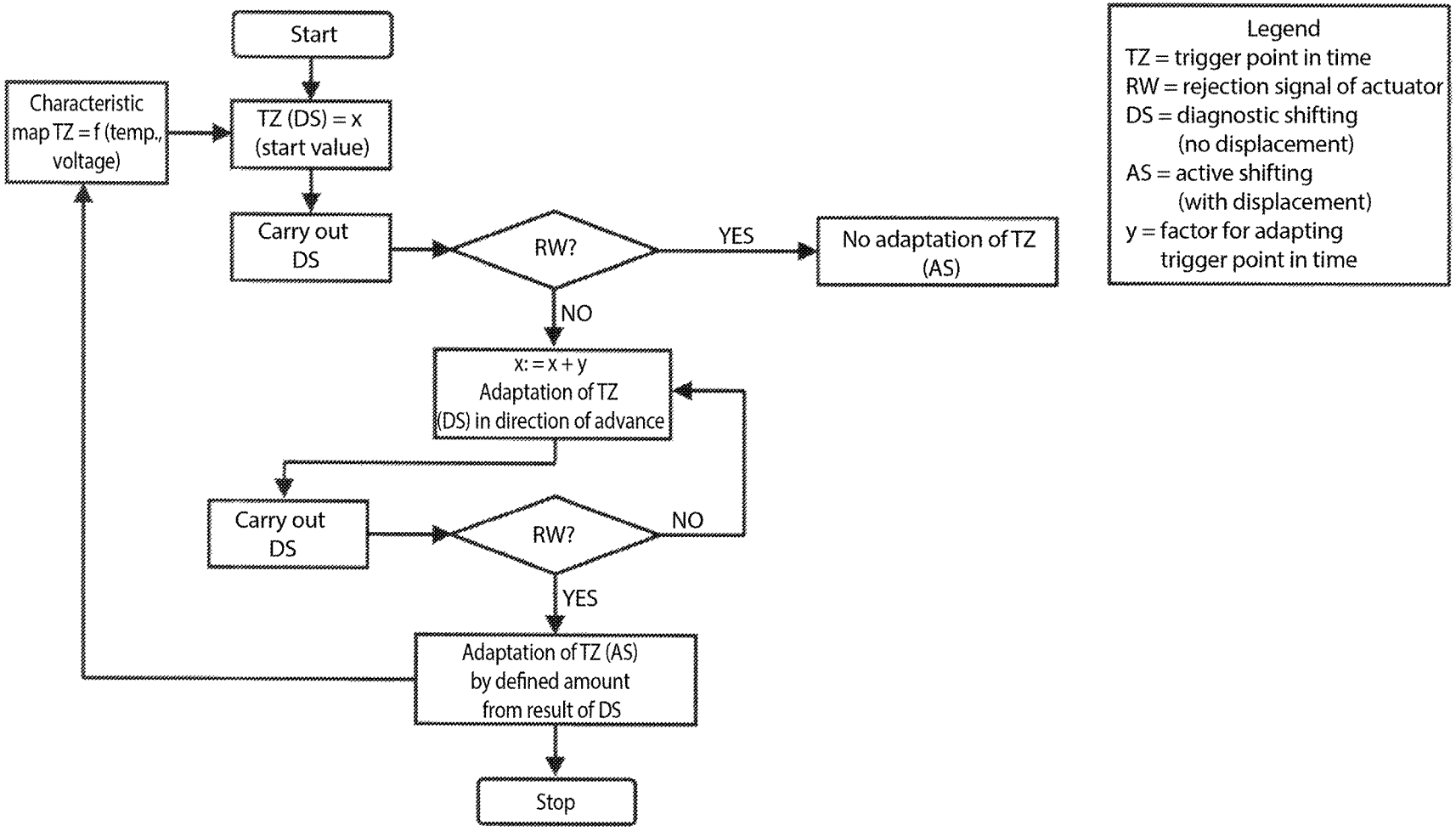
FIG. 5 shows a basic flow chart of the diagnostic method.

FIG. 5 shows the basic flow chart when carrying out the diagnostic shifting DS. If a rejection signal is generated already with the trigger point in time TZ=x as the start value, i.e. RW?=YES, then the actuator characteristic map, stored in a control unit, whose current parameters are used for the purpose of displacing the sliding cam (=active shifting AS) to control the associated actuator pin, remains unchanged. If, on the other hand, no rejection signal is detected, i.e. RW?=NO, then the original trigger point in time TZ—which in FIG. 4 corresponds to the start of energization B'—is brought forward by the value y to an earlier point in time in the direction B as many times as necessary until RW?=YES. The actuator characteristic map is then updated with the last trigger point in time TZ/start of energization B thus changed.

The diagnostic shifting is carried out not only at predefined long-term intervals to update the actuator characteristic map with the dead times, which change due to progressive wear, individually for all actuators. Instead, the diagnosis also takes place in different operating states of the internal combustion engine, in particular at a different operating temperature or with a different supply voltage (vehicle electrical system voltage) as characteristic map parameters.

Figure 6:
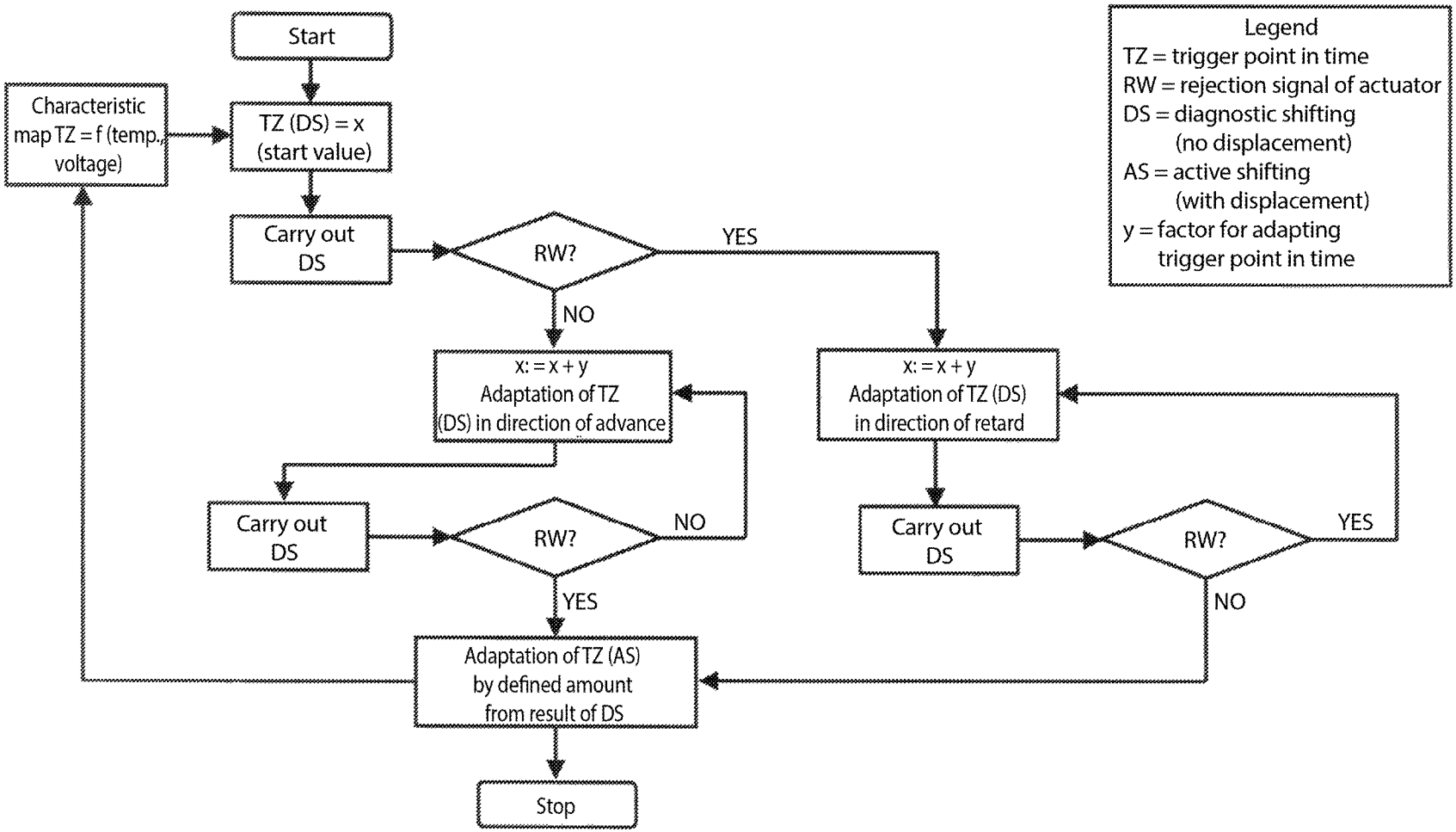
FIG. 6 shows a flow chart, expanded in comparison to FIG. 5, for more precise demarcation of the dead time.

FIG. 6 shows a flow chart, expanded in comparison to FIG. 5, with increased accuracy of the dead time ascertainment. If a rejection signal is generated already with the trigger point in time TZ=x as the start value, i.e. RW?=YES, the original trigger point in time TZ—which in FIG. 4 corresponds to the start of energization B—is shifted by the value y to a later point in time in the direction B' as many times as necessary until RW?=NO. The actuator characteristic map is then updated with that trigger point in time TZ/start of energization B for which RW?=YES was last detected, i.e., with the penultimate trigger point in time.

Figure 7:
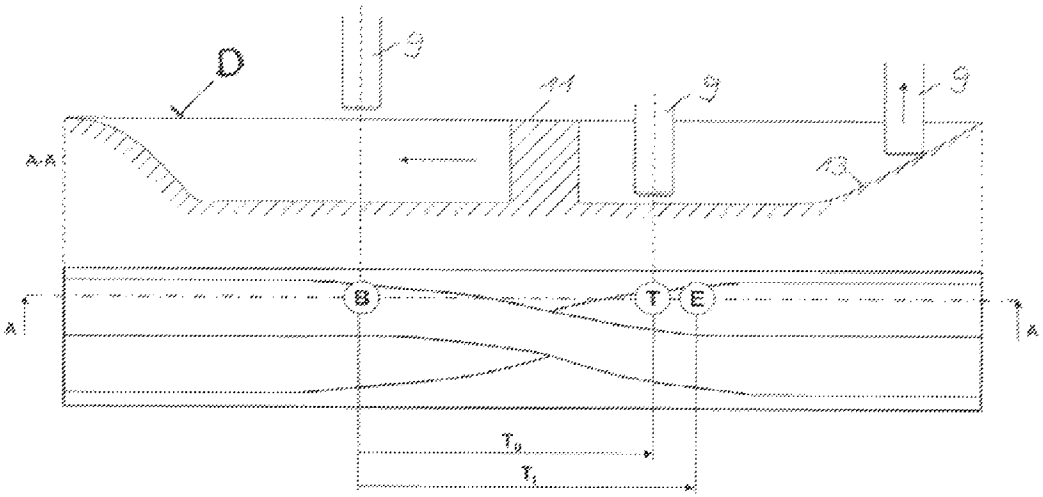
FIG. 7 is analogous to FIG. 3, showing a first alternative displacement slot (X-shaped groove)
Figure 8:
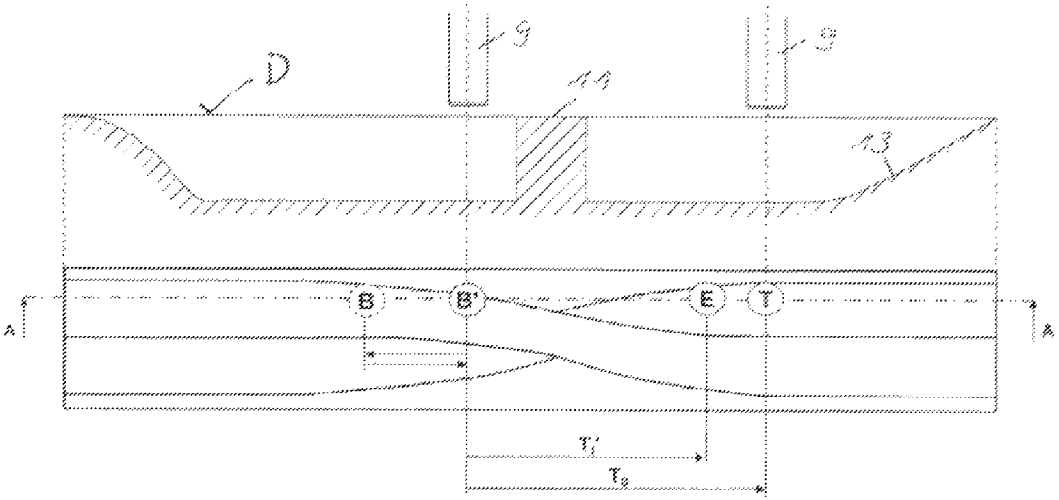
FIG. 8 is analogous to FIG. 4, showing the first alternative displacement slot.
Figure 9:
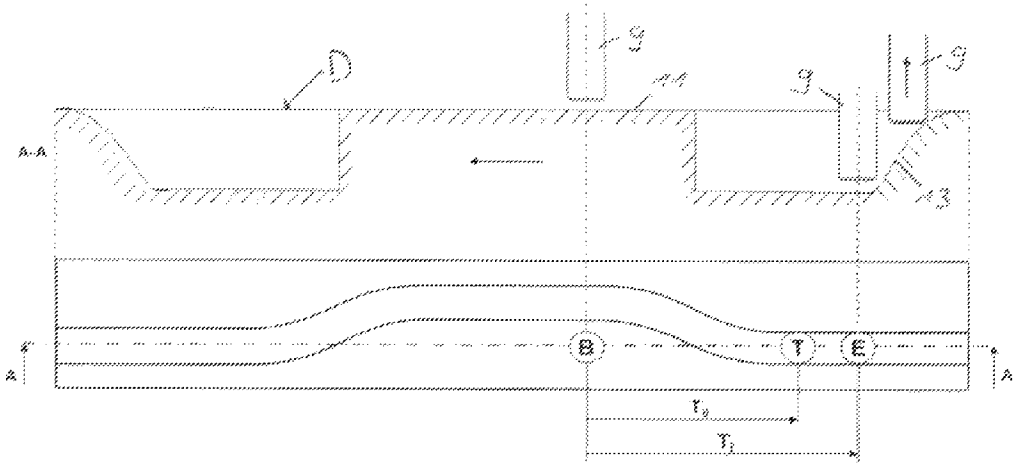
FIG. 9 is analogous to FIG. 3, showing a second alternative displacement slot (double-S-shaped groove)
Figure 10:
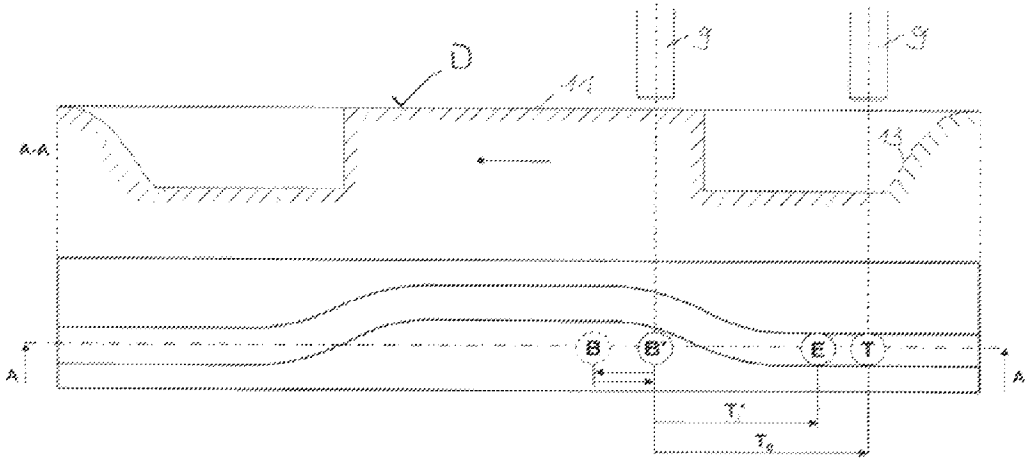
FIG. 10 is analogous to FIG. 4, showing the second alternative displacement slot.

FIGS. 7 and 8 and respectively 9 and 10 are diagrams analogous to FIGS. 3 and 4 showing alternative and likewise known displacement slots. The displacement slot shown in FIGS. 7 and 8 has two grooves 7 and 8 which are situated in parallel to one another on the circumference of the cam unit and which intersect approximately in the middle of the circumference. A further alternative to this so-called X-shaped groove is the displacement slot shown in FIGS. 9 and 10, which is referred to as the double-S-shaped groove and in which the axial bumps of the two groove tracks are arranged in series, i.e., entirely behind one another on the circumference. For the diagnostic method according to the present invention, the above-mentioned explanations given for the Y-shaped groove shown in FIGS. 2 through 4 apply analogously.

LIST OF REFERENCE NUMERALS

1 carrier shaft
2 sliding cam
3 cam
4 cam
5 cam follower
6 gas exchange valve
7 left-hand groove
8 right-hand groove
9 actuator pin
10 actuator pin
11 web
12 united groove
13 upward slope

What is claimed is:

1. A method for diagnosing an electromagnetic actuator of a sliding cam valve train of an internal combustion engine, the actuator having at least one actuator pin, the at least one actuator pin, as a result of electrical energizing of the actuator, being released and dipping into a groove-like displacement slot passing through a cylindrical slot section of the associated sliding cam and ending, in the rotation direction of the cam, with an upward slope onto the cylindrical circumference of the slot section, the method comprising the following diagnostic steps carried out during operation of the internal combustion engine:

a) energizing the actuator with current parameters of a variable actuator characteristic map in such a way that the actuator pin is released when the cylindrical circumference overlaps the actuator pin circumferentially and a directly subsequent dip of the actuator pin into the displacement slot does not result in any displacement of the sliding cam;

b) detecting whether the released actuator pin generates in the actuator a rejection signal due to the upward slope from the displacement slot onto the cylindrical circumference;

c) if no rejection signal is detected, repeating step a) using at least one changed current parameter and step b); and d) updating the actuator characteristic map with the changed current parameter.

2. The method as recited in claim 1 wherein the actuator has two actuator pins selectively released and dipped into a left-hand groove and a right-hand groove of the displacement slot, the left-hand and right-hand grooves, running separated from one another by the cylindrical circumference, uniting in the rotation direction of the cam to form a united groove ending with the upward slope onto the cylindrical circumference, the diagnostic step a) being carried out in such a way that the actuator pin that is released is the actuator pin in circumferential overlap with the cylindrical circumference between the left-hand and right-hand grooves.

3. The method as recited in claim 1 wherein the current parameter to be changed is a duration of energization of the actuator.

4. The method as recited in claim 3 wherein the duration of energization is changed only by the start of energization of the actuator.

5. The method as recited in claim 3 wherein, if a rejection signal is detected, steps a) and b) are repeated with a changed duration of energization as many times as necessary until a rejection signal is no longer detected, the actuator characteristic map being updated with the penultimate duration of energization.

6. The method as recited in claim 1 wherein the diagnostic steps are carried out on all actuators of the valve train.

7. The method as recited in claim 1 wherein the diagnostic steps are carried out on the actuator in different operating states of the internal combustion engine or after predetermined operating time intervals.

8. The method as recited in claim 7 wherein the different operating states include an operating temperature of the internal combustion engine and a supply voltage to the actuators.

* * * * *